US006767421B1

(12) United States Patent
Von Der Heide et al.

(10) Patent No.: US 6,767,421 B1
(45) Date of Patent: Jul. 27, 2004

(54) METHOD OF PRODUCING PANEL-SHAPED PRODUCTS

(75) Inventors: Kay-Henrik Von Der Heide, Darmstadt (DE); Gernot Von Haas, Leimen (DE)

(73) Assignee: Dieffenbacher Schenck Panel GmbH, Pfungstadt (DE)

( * ) Notice: Subject to any disclaimer, the term of this patent is extended or adjusted under 35 U.S.C. 154(b) by 0 days.

(21) Appl. No.: 09/914,933

(22) PCT Filed: Feb. 28, 2000

(86) PCT No.: PCT/EP00/01661

§ 371 (c)(1),
(2), (4) Date: Sep. 4, 2001

(87) PCT Pub. No.: WO00/53379

PCT Pub. Date: Sep. 14, 2000

(30) Foreign Application Priority Data

Mar. 5, 1999 (DE) ..... 199 09 607

(51) Int. Cl.[7] ..... B27N 3/00; B27N 3/06

(52) U.S. Cl. ..... 156/182; 156/62.2; 156/331.4; 264/109; 264/112; 264/113

(58) Field of Search ..... 156/62.2, 182, 156/296, 331.4, 331.7; 264/109, 112, 113; 428/297.1, 292.4, 300.7, 532, 537.1

(56) References Cited

U.S. PATENT DOCUMENTS

| | | | | |
|---|---|---|---|---|
| 3,779,843 A | * | 12/1973 | Knapp | 156/64 |
| 4,038,531 A | * | 7/1977 | Loe, Jr. | 700/112 |
| 4,045,595 A | * | 8/1977 | Chiu et al. | 427/202 |
| 4,268,649 A | | 5/1981 | Jellinek et al. | |
| 4,393,019 A | * | 7/1983 | Geimer | 264/83 |
| 5,554,330 A | * | 9/1996 | Flannery et al. | 264/113 |
| 5,779,955 A | | 7/1998 | Siempelkamp | |
| 6,007,649 A | | 12/1999 | Haas et al. | |
| 6,533,889 B2 | * | 3/2003 | Dueholm | 156/296 |

FOREIGN PATENT DOCUMENTS

| | | | | |
|---|---|---|---|---|
| AT | 270189 | | 4/1969 | |
| DE | 7717108 | | 1/1978 | |
| DE | 2716971 | | 10/1978 | |
| DE | 2832509 | | 1/1980 | |
| DE | 3730776 | | 3/1989 | |
| DE | 3820376 | | 12/1989 | |
| DE | 3820376 | A * | 12/1989 | ..... B27N/3/26 |
| DE | G209289 | | 10/1992 | |
| DE | 10049050 | A1 * | 4/2002 | ..... B27N/3/02 |
| EP | 0346864 | | 12/1989 | |
| EP | 0511425 | | 11/1992 | |
| GB | 1148016 | | 4/1969 | |
| WO | 0877767 | | 8/1977 | |

OTHER PUBLICATIONS

E. Schriever, "Diisocyanat– und Polyurethanklebstoffe für Holz und Holawerkstoffe"; Fraunhofer–Institut für Holzforschung, Wilhelm—Klauditz—Institut; Mar., 1982, WKI–Bericht Nr. 14, pp. 4 to 17.

G. Loew, "Isocyanate as a binder for particle board"; Engineer H. I. Sachs of Bayer AG, 1977, pp. 473–492.

* cited by examiner

*Primary Examiner*—Sue A. Purvis
(74) *Attorney, Agent, or Firm*—W. F. Fasse; W. G. Fasse

(57) ABSTRACT

A method of making panel-shaped products by hot-pressing a multi-layered formed body of chips of lignocellulose-containing annual plants impregnated with an isocyanate binder, is to avoid the problem of the adhesion of the isocyanate binder. For this purpose, the cover layer material is divided into a cover layer material fine fraction (5*a*) and a cover layer material coarse fraction (5*b*), whereby the cover layer material fine fraction (5*a*) is pre-mixed with adhesion promoters and/or wetting agents and/or acids and/or bases, and next glued with amino and/or phenolic plastics, and the cover layer material coarse fraction (5*b*) is glued with isocyanate or mixtures of isocyanate and amino and/or phenolic plastics. Next, a five-layered formed body is spread, whereby the outermost cover layers of the formed body consist of the cover layer material fine fraction glued with amino and/or phenolic plastics.

15 Claims, 1 Drawing Sheet

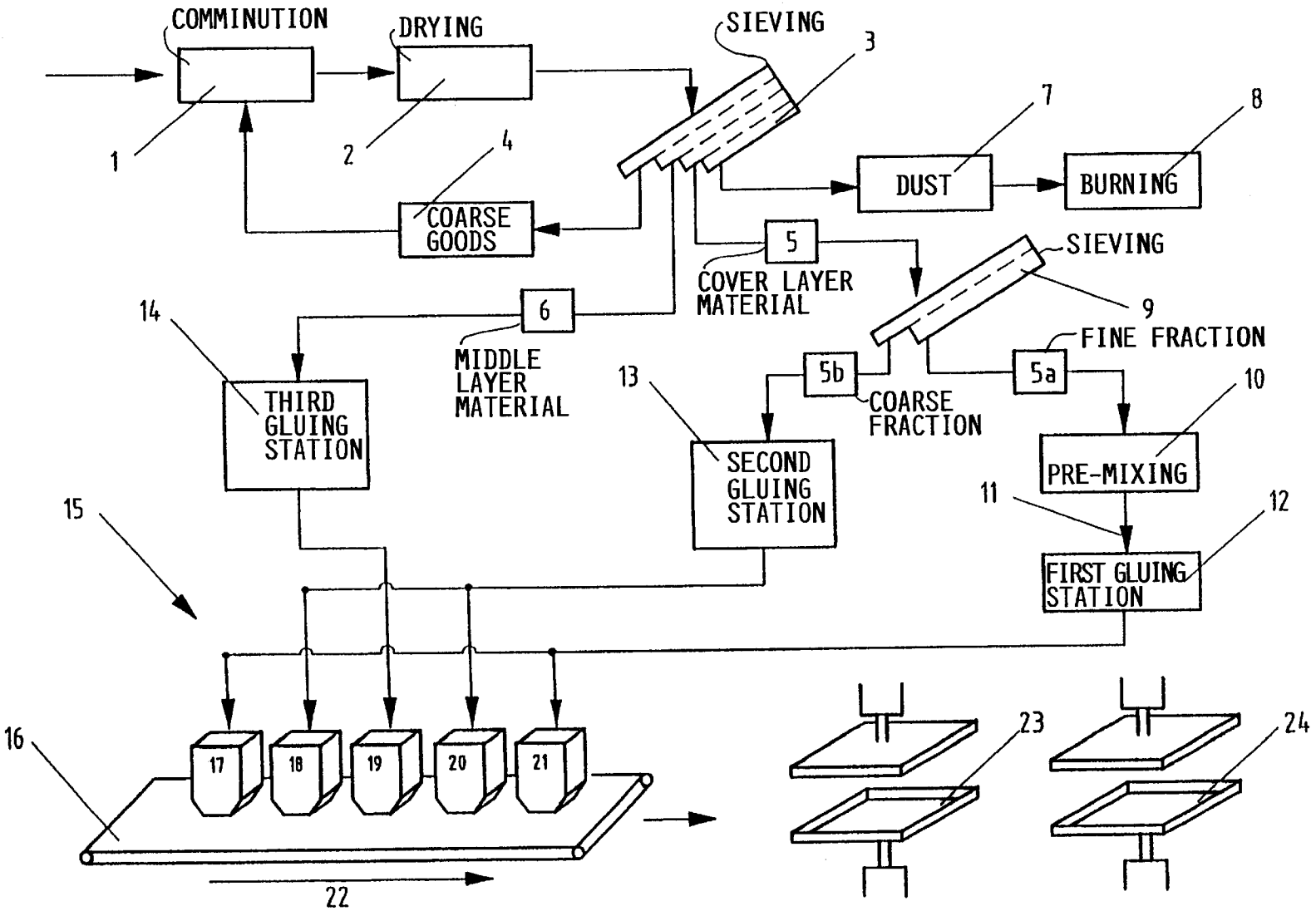
COMMINUTION
1
DRYING
2
SIEVING
3
COARSE GOODS
4
COVER LAYER MATERIAL
5
MIDDLE LAYER MATERIAL
6
DUST
7
BURNING
8
SIEVING
9
FINE FRACTION
5a
COARSE FRACTION
5b
PRE-MIXING
10
11
FIRST GLUING STATION
12
SECOND GLUING STATION
13
THIRD GLUING STATION
14
15
16
17
18
19
20
21
22
23
24

METHOD OF PRODUCING PANEL-SHAPED PRODUCTS

FIELD OF THE INVENTION

The invention relates to a method of manufacturing pressed panel-shaped products comprising chips of lignocellulosic annual plants and a binder.

In the production of multi-layered plates or panels of lignocellulose-containing materials, it is known to use isocyanate as a binder. The use of isocyanate as a binder for panel products as well as the advantages and disadvantages resulting therefrom are described in the special publication "Isocyanate as a binder for particle board" by Dr. G. Loew, an Engineer H. I. Sachs of Bayer A G, from 1977, on page 479. From this it is evident that polyisocyanates adhere onto metals under pressure and heat. As a solution possibility to these problems, the use of liquid separating agents as well as the use of papers, veneers, as well as dust or conventionally adhesive bonded or glued chip cover layers is suggested.

A method for the production of multi-layered panel materials of a mass of wood chips, wood fibers, or of lignified raw materials, impregnated with isocyanate, is known from the Austrian Patent 270,189. Furthermore it is known from this publication, to use a mixture of isocyanate as well as urea-, melamine-, and phenol formaldehyde resin glue or adhesive as a binder, or for example, to bind the chips in the cover layer with melamine resin and the chips of the middle layer with pure isocyanate solution, or vice versa. By the use of a mixture of the above named binders, a strongly increased moisture resistance and a considerable reduction of the swelling of the panel products upon the penetration of moisture are achieved.

From the U.S. Pat. No. 5,779,955, a method for the production of panel materials is known, in which particles of plant-related products are mixed with isocyanate as a binder as well as water, as the panel material. In order to avoid the problems of the adhering of the mats during the pressing, which problems arise with the use of isocyanate as a binder, the underlayer is covered with a liquid separating agent before the spreading of the mixture. After the spreading process, a separating agent is similarly applied onto the top surface of the laid-down mixture. Thereafter, the hot pressing of the formed body is carried out.

Moreover, a method for the production of multi-layered chip panels by hot pressing of woodchips impregnated with binder is known from the German Patent Laying-Open Document 38 20 376. In this context, isocyanate is used as a binder in combination with formaldehyde binding agents, such as urea or the like, is used as a binder in the core layer. In the cover layers, isocyanate is used as a binder In order to avoid the already described problem of the adhesion of the mats during the pressing, separating cover layers are provided on the cover layers. These separating cover layers are bonded with phenolic resin and are again removed after the hardening or curing.

SUMMARY OF THE INVENTION

Object of the present invention is to provide a method for the production of multi-layered panel-shaped products of lignocellulose-containing annual plants, in which especially the problems of the adhesion in the use of isocyanate as a binder are avoided.

This object is achieved according to the invention in a method wherein a cover layer material of chips of at least one lignocellulose-containing annual plant is separated into a cover layer material fine fraction and a cover layer material coarse fraction, the cover layer material fine fraction is premixed with an adhesion promoter and/or a wetting agent and/or acids and/or bases, and next is glued with amino and/or phenolic plastics, the cover layer material coarse fraction is glued with isocyanate or mixtures of isocyanate and amino and/or phenolic plastics, and next the cover layer material fine fraction, the cover layer material coarse fraction, and the middle layer material are spread in respective layers to form a five-layered formed body, whereby outermost cover layers of the formed body consist of the cover layer material fine fraction that is glued with amino and/or phenolic plastics.

By means of the separation or division of the cover layer material into a fine fraction and a coarse fraction described in the method according to the invention, it is possible to glue the fine fraction with amino and/or phenolic plastics through a pretreatment of the fine fraction with supplemental or additive agents. Due to the higher degree of comminution of the fine fraction, the wetting capacity of the particles of lignocellulose-containing annual plants with amino and/or phenolic plastics as a binder is advantageously influenced. The addition of wetting agent additionally improves the wetting characteristics. A further addition of an adhesion promoter during the premixing achieves a clear improvement of the adhesion or bonding characteristics of the particles. Since the outer cover layers are glued with amino and/or phenolic plastics, the problems of the adhesion of isocyanate glued chips on the panel or plate surfaces during the pressing are avoided. In the method according to the invention, no additional separating agents or separating layers are necessary, so that additional costs are avoided.

The cold adhesiveness present in the outer cover layers achieves a surface stability of the outer layers of the spread formed body, so that the multi-layered formed body may be transported over the individual transfer area in the forming or extrusion line to the press inlet without damaging the previously achieved cover layer quality.

A use of a binder mixture of isocyanate and phenolic and/or amino plastics leads to a cost reduction, in comparison to the exclusive use of isocyanate as a binder for the middle layer material as well as the cover layer material coarse fraction, due to a reducing proportion of isocyanate.

BRIEF DESCRIPTION OF THE DRAWING

The method according to the invention will be described in detail in connection with an example embodiment, which is shown in FIG. 1.

DETAILED DESCRIPTION OF A PREFERRED EXAMPLE EMBODIMENT AND OF THE BEST MODE OF THE INVENTION

In FIG. 1, the method for the production of a five-layered chip panel is schematically shown. In the method according to the invention for the production of a five-layered chip panel, first the preparation of the raw material is carried out. Lignocellulose-containing annual plants are used as raw material. For example grain straw, rice straw, hemp, flax, soybean straw, belong to the lignocellulose-containing annual plants. In the following description of the method for the production of a five-layered chip panel, grain straw is used as raw material.

The grain straw is first prepared in a multi-stage size reduction or comminution process 1. The comminuted grain straw is next dried in a dryer 2 to a final moisture of approx.

2 to 5%. In a sieve station 3 following thereupon, the dried grain straw is separated into the fractions coarse goods 4, cover layer material 5, middle layer material 6, and dust 7. The coarse goods 4 are delivered back into the comminution process 1, the dust 7 is delivered to a burning or combustion system 8. In a subsequent second sieve station 9, the cover layer material 5 is separated into two fractions, cover layer fine fraction 5*a* and cover layer coarse fraction 5*b*. The cover layer fine fraction 5*a* is next mixed with supplement or additive agents such as free acids or bases as well as addition of wetting agent and/or adhesion promoter in a pre-mixer 10. The addition of free acids or bases is adjustingly set dependent on the binder to be used. The cover layer fine fraction 5*a* that has been prepared in this manner is next delivered to a first gluing station 12. The required dwell time or waiting time for penetrating effectiveness of the supplement or additive agents is achieved by the conveyor paths as well as intermediate silos, which lie between the pre-mixer 10 and the first gluing station 12, and which are shown by arrow 11 in the schematic illustration according to FIG. 1. In a further embodiment of the method according to the invention, it is provided that the wetting agents and/or adhesion promoters are added directly before the first gluing station 12. In the first gluing station 12, the pretreated cover layer fine fraction 5*a* is glued with amino plastics as a binder. Instead of amino plastics, phenolic plastics or mixtures thereof could also be used. The cover layer material coarse fraction 5*b* is delivered to a second gluing station 13. In the second gluing station 13, the cover layer material coarse fraction 5*b* is glued with isocyanate as a binder. In the second gluing station 13, water or other additives can be added in addition to the binder. The possibility also exists, to add isocyanate in emulsified form to the gluing station. In a further embodiment, the cover layer material coarse fraction 5*b* could also be glued with a mixture of isocyanate and phenolic and/or amino plastics. In this context it is suitable for the purpose, to previously deliver the cover layer material coarse fraction 5*b* similarly to a pre-mixer, and to mix the cover layer material coarse fraction 5*b* with supplemental or additive agents such as free acids or bases as well as addition of wetting agents and/or adhesion promoters.

In a further embodiment variant it is provided not to divide the cover layer material into two fractions, but rather to prepare the entire cover layer material dependent on the degree of comminution in such a manner so that a gluing and pretreatment in conformance with the above described manner of the processing method for material 5*a* is possible.

The middle layer material 6 acquired through the grain straw preparation is delivered to a third gluing station 14. In the third gluing station 14, the middle layer material 6 is glued with isocyanate as a binder. In the third gluing station 14, water or other additives can be added additionally to the binder. The possibility also exists to add isocyanate in emulsified form to the gluing station. Furthermore, a mixture of isocyanate and phenolic and/or amino plastics could be used as a binder. As the case may be, a pre-mixing with supplemental or additive agents is then similarly necessary.

After the middle layer material 6 as well as the cover layer materials fine fraction 5*a* and coarse fraction 5*b* are glued in the gluing stations 12, 13, 14 with the above described binders, the glued fractions are delivered to a forming station 15. In the production method according to the invention according to the schematic illustration of FIG. 1, the form station 15 consists of five spreading units 17, 18, 19, 20, 21 arranged one after another in the transport direction of the forming belt or band 16. The transport direction is indicated by the arrow 22. The glued cover layer material fine fraction 5*a* is delivered to the first spreading unit 17 and is spread as a first layer onto the forming band 16. The glued cover layer material coarse fraction 5*b* is delivered to the second spreading unit 18 following thereupon and is then spread onto the first layer. Glued middle layer material 6 is delivered to the third spreading unit 19 and is spread as a third layer onto the second layer. Glued cover layer material coarse fraction 5*b* is delivered to the fourth spreading unit 20 and is spread as a fourth layer onto the third layer. Glued cover layer material fine fraction 5*a* is delivered to the fifth spreading unit 21 and spread as a fifth layer onto the fourth layer. In this manner, a five-layered formed body is spread continuously onto the forming band 16, whereby the outer cover layers consist of cover layer material fine fraction 5*a* glued with amino and/or phenolic plastics. The spread five-layered formed body is next delivered to a continuous pre-press 23, which achieves a pre-pressing or pre-compression of the formed body. After the pre-pressing, the formed body is hot pressed in a further press 24. This further press can be embodied as a continuous press or as a cycling press. Before the hot pressing of the five-layered formed body, it is advantageous to spray the formed body surfaces with a liquid. In this manner, the through-heating of the mat during the hot pressing will be accelerated due to the so-called "steam jet effect".

What is claimed is:

1. A method of producing a panel-shaped product by hot pressing a multi-layered formed body of chips of at least one lignocellulose-containing annual plant impregnated with binder, whereby isocyanate is used as a binder for a middle layer material of the chips in a middle layer of the formed body, characterized in that:

a cover layer material of the chips is separated into a cover layer material fine fraction (5*a*) and a cover layer material coarse fraction (5*b*), the cover layer material fine fraction (5*a*) is premixed with an adhesion promoter and/or a wetting agent and/or acids and/or bases, and next is glued with amino and/or phenolic plastics, the cover layer material coarse fraction (5*b*) is glued with isocyanate or mixtures of isocyanate and amino and/or phenolic plastics, and next the cover layer material fine fraction, the cover layer material coarse fraction, and the middle layer material are spread in respective layers to form the multi-layered formed body as a five-layered formed body, whereby outermost cover layers of the formed body consist of the cover layer material fine fraction that is glued with amino and/or phenolic plastics.

2. The method according to claim 1, characterized in that grain straw is used as the lignocellulose-containing annual plant.

3. The method according to claim 1, characterized in that a mixture of wheat and barley straw is used as the lignocellulose-containing annual plant.

4. The method according to claim 1, characterized in that a moisture content of the cover layers as well as of the middle layer lies between 0 and 25%.

5. The method according to claim 1, characterized in that a moisture content of the cover layers as well as of the middle layer lies between 0 and 12%.

6. The method according to claim 1, characterized in that the isocyanate is diphenylmethanediisocyanate.

7. The method according to claim 6, characterized in that 2 to 10% of the diphenylmethanediisocyanate relative to a dry mass proportion of the chips is used.

8. The method according to claim 1, characterized in that the cover layer material fine fraction is premixed with the adhesion promoter and/or the wetting agent directly before being glued with the amino and/or phenolic plastics.

9. The method according to claim 1, characterized in that a proportion of the cover layer material coarse fraction relative to a total of the cover layer material lies between 0 and 80% dependent on the degree of comminution.

10. The method according to claim 1, characterized in that a proportion of the cover layer material coarse fraction relative to a total of the cover layer material lies between 0 and 50% dependent on the degree of comminution.

11. A method of making a pressed chip panel comprising the steps:

a) providing a cover layer material comprising chips;

b) separating said cover layer material into a cover layer material fine fraction and a cover layer material coarse fraction;

c) premixing said cover layer material fine fraction with at least one of an adhesion promoter, a wetting agent, an acid, and a base;

d) after said step c), applying to said cover layer material fine fraction a first binder comprising at least one of an amino resin and a phenolic resin;

e) applying to said cover layer material coarse fraction a second binder comprising an isocyanate;

f) providing a middle layer material comprising chips;

g) applying to said middle layer material a third binder comprising an isocyanate;

h) after said steps d), e) and g), spreading a first outer cover layer of said cover layer material fine fraction, thereon spreading a first intermediate layer of said cover layer material coarse fraction, thereon spreading a middle layer of said middle layer material, thereon spreading a second intermediate layer of said cover layer material coarse fraction, and thereon spreading a second outer cover layer of said cover layer material fine fraction, to form of said layers a five-layered body; and i) hot-pressing said five-layered body to form said pressed chip panel.

12. The method according to claim 11, wherein said chips of said cover layer material and said chips of said middle layer material respectively comprise chips of at least one lignocellulose-containing annual plant.

13. The method according to claim 11, wherein said second binder further comprises at least one of an amino resin and a phenolic resin mixed with said isocyanate.

14. The method according to claim 11, wherein said first binder does not contain any isocyanate.

15. The method according to claim 11, wherein said third binder further comprises at least one of an amino resin and a phenolic resin mixed with said isocyanate.

* * * * *